United States Patent [19]

Schwickart et al.

[11] 4,045,325

[45] Aug. 30, 1977

[54] MEMBRANE SEAL FOR ELECTROLYSIS PLATE AND FRAME ASSEMBLIES

[75] Inventors: Karl-Josef Schwickart, Siershahn, Ww.; Lothar Sesterhenn, Dormagen, both of Germany

[73] Assignee: Bayer Aktiengesellschaft, Leverkusen, Germany

[21] Appl. No.: 651,330

[22] Filed: Jan. 21, 1976

[30] Foreign Application Priority Data

Jan. 27, 1975 Germany ..... 2503215

[51] Int. Cl.[2] ..... C25B 1/24; C25B 9/00

[52] U.S. Cl. ..... 204/286; 204/256; 204/268

[58] Field of Search ..... 204/256, 252, 253, 267, 204/268, 286

[56] References Cited

U.S. PATENT DOCUMENTS

| | | | |
|---|---|---|---|
| 3,477,938 | 11/1969 | Kircher | 204/286 X |
| 3,778,362 | 12/1973 | Wiechers et al. | 204/286 X |
| 3,836,438 | 9/1974 | Sartre et al. | 204/286 X |
| 3,875,040 | 4/1975 | Weltin et al. | 204/286 X |
| 3,915,836 | 10/1975 | Born et al. | 204/286 |

*Primary Examiner*—Arthur C. Prescott

*Attorney, Agent, or Firm*—Burgess, Dinklage & Sprung

[57] ABSTRACT

In a hydrochloric acid electrolysis plate and frame assembly comprising a graphite plate and a frame about said plate so as to provide a gas tight seal while maintaining a sliding fit, the improvement which comprises a tension-free membrane seal fastened to the frame and to the plate across the space where sliding movement therebetween can occur. The membrane advantageously comprises a fabric or film of polyvinyl chloride, polypropylene or a poly-fluoroolefin and is fastened to at least one of said frame and plate by being cemented or bonded. An additional resilient seal such as asbestos fibers may be provided in the space between said plate and frame which space changes in size upon sliding between said plate and frame.

6 Claims, 6 Drawing Figures

MEMBRANE SEAL FOR ELECTROLYSIS PLATE AND FRAME ASSEMBLIES

Figure 1:
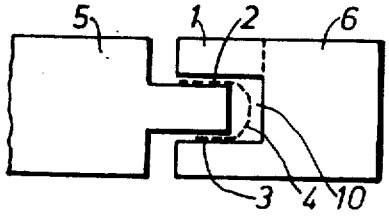

This invention relates to a flexible seal for hydrochloric acid electrolysis frames with an inserted graphite plate which functions free from tension in every operational phase.

The electrolysis of hydrochloric acid is generally carried out in a cell block or electrolyzer consisting of 30 to 45 individual cells which operate at current densities of up to 5000 A/m². The basic element, the actual cell, is a frame of a plastic material which contains collecting channels for the products flowing off and for the introduction and discharge of anolyte and catholyte. Inserted into the frame is the bipolar graphite plate which is provided with slots on both sides (cathode and anode side). The gases ascend along the vertical electrodes and, at the upper edge of the graphite plate, are distributed into the outlet openings through a channel system, the chlorine with the anolyte being guided to one end and the hydrogen with the catholyte to the other end. The diaphragm is fastened to the sides of the frame (Chemie Ingenieur Technik, 39,729(1967).

In these known electrolyzers the current-conducting electrode plates can be cemented into the frame consisting of an insulating plastic material. Serious disadvantages are involved in connecting the frame of the electrolyzer to the electrodes in this way. Frequent interruptions can occur during electrolysis, because inter alia cracks and hence leaks can be formed in the cement and in particular in the frame at the different temperatures which occur due to the difference between the expansion coefficients of the plastic material and the electrode material.

A second form of connection between the frame and the electrodes is the so-called interlocking connection where the frame and electrode are joined together by tongue and groove. Although a connection of this kind provides for the required displacement of the graphite plate in the frame, it cannot be made gas tight at reasonable cost.

It is disclosed in Application Ser. No. 354,033 filed Apr. 24, 1973 now U.S. Pat. No. 3,875,040 and Application Ser. No. 457,737 filed Apr. 4, 1974 now pending that, in order to avoid the formation of cracks in the outer plastic frame due to differential thermal expansion or progressive shrinkage of the plastic material used, the electrolysis frame can be non-rigidly connected to the graphite plate (electrode) so that the frame and electrode are able to move relative to one another. This non-rigid connection between the frame and the electrode, which enables them to move relative to one another, is referred to hereinafter as a "sliding-fit connection". For the sliding-fit connection between the frame and electrode, it is important that the connection should be substantially gas tight in order to guarantee the purity of the gases, hydrogen and chlorine, produced on both sides of the graphite plate. In addition, the seal should not interfere with the relative movement between the graphite plate and the frame, should not give rise to any stressing which could in turn lead to crack formation, and should be chemically resistant to the electrolytes and electrolysis gases under normal working conditions.

In order to meet these requirements, it has been proposed to use electrolysis frames with a sliding fit connection between the graphite plate and an electrically non-conductive frame, which show a minimal sealing gap by virtue of extremely accurate machining of the adjoining surfaces.

Application Ser. No. 457,737 filed Apr. 4, 1974 now pending, discloses another known non-rigid connection between the plastic frame and the graphite plate with a sliding-fit connection, wherein the sliding-fit connection is sealed by the subsequent application of cementing lugs to the electrolysis frame. In this case, the sealing gap is minimized largely independently of the quality of the machining. Furthermore an elastomeric seal can be introduced between the frame and the graphite plate.

It has been found that it is not possible in the case of sliding fit connections to obtain the necessary gas tightness solely by minimizing the sealing gap.

Additional sealing by means of an inserted elastomeric material has hitherto failed on account of the limited chemical resistance of the available materials (destruction, swelling, creep or hardening). In addition, reliable sealing requires a certain contact pressure which can in turn give rise to deformation and crack formation. In addition, this contact pressure is subjected to uncontrollable changes due to the various operational phases and to the above described behavior of the sealing material.

Accordingly, the object of the present invention is to provide a seal for electrolysis frames with an inserted graphite plate which shows an improved gas tightness and, at the same time, guarantees freedom from stressing between the components in all operational phases.

Accordingly, the present invention provides a hydrochloric acid electrolysis frame with an inserted graphite plate, the frame and the graphite plate being connected in gas tight manner through a sliding fit, characterized by the fact that a tension-free membrane seal is inserted between those parts of the frame which are movable relative to one another and the graphite plate, being fastened to the frame and to the graphite plate.

In the context of the invention, a membrane seal is, for example, a cloth, a nonwoven fabric or a film consisting of chemically resistant materials, for example, heat-stabilized polyvinyl chloride, polypropylene or polymers of fluorinated alkenes for example, ethylene and/or propylene, especially polytetrafluorethylene. This membrane seal is preferably bonded or cemented to the electrolysis frame and the graphite plate, guaranteeing a substantially tension-free seal by virtue of its elasticity. The membrane is arranged so loosely that the full range of movement between the graphite plate and the plastic frame can be utilized without destroying the membranes. The membranes may be fixed to the electrolysis frame or graphite plate with particular advantage, so far as assembly and gas tightness are concerned, by bonding or cementing into a groove. In one preferred embodiment, the membrane is cemented into cementing lugs arranged on the electrolysis frame in accordance with the teaching of Application Ser. No. 457,737. Since the seals usable in accordance with the invention are generally difficult to bond, it is advisable to cement them in position, a thermally applied peripheral bead or a perforated peripheral zone, for example guaranteeing mechanical strength in the cemented joint. The film may also be thermally preformed in known manner in order to facilitate assembly.

Suitable adhesives or cements are, for example, furan resins and also phenol-formaldehyde resins.

The invention will be further described with reference to the accompanying drawing, wherein:

FIGS. 1 to 6 are schematic views showing alternative locations for securing a membrane seal to the plate and frame, only those portions of the plate and frame in the area of the sliding fit therebetween being shown.

In the figures the reference numerals have the following meanings:

1 = cementing lug on the electrolysis frame;
2 = bonding or cementing-in/membrane/graphite plate;
3 = bonding or cementing/membrane/electrolysis frame;
4 = membrane
5 = graphite plate;
6 = frames;
7 = frame member;
8 = clamping or bonding or cementing/membrane/electrolysis frame;
9 = screw joint between frame of member and electrolysis frame
10 = intermediate space.

The cementing lug 1 used in FIGS. 1 to 4 is stabilized during production by an inserted polypropylene fillet which prevents the fresh cement from sinking into the space 10 between the graphite plate and the frame.

In cases where a cloth or a nonwoven fabric is used in the embodiment shown in FIG. 1, a separation film (not shown) is placed over the membrane seal in order to prevent the cloth or nonwoven from adhering undesirably to the cementing lug.

The gas tightness of these embodiments can be further improved by introducing a suitable sealing material, such as asbestos, thermoplastic cloths or elastomeric plastics, into the empty space between the frame and the graphite plate.

In FIG. 1, the membrane 4 is bonded first to the sliding surface of the frame 3 and then, following introduction of the graphite plate, to the upper sliding surface 2. A gas tight connection is thus established. This embodiment is particularly suitable in cases where a cloth membrane is used, because the sealing effect of the cloth material situated in the sliding gap is additionally utilized.

Figure 2:
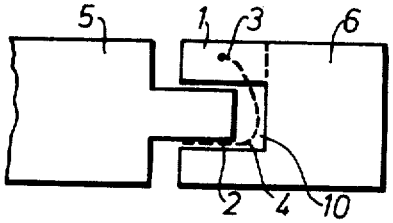

In FIG. 2, the membrane 4 is bonded on one side to the sliding surface of the graphite plate 2 and, on the other side is fastened to the frame and fixed in the cementing lug 1 by cementing in. This embodiment is simple, the sliding surface of the frame remains untouched and, in cases where a cloth or nonwoven is used, an additional gap sealing effect is obtained in the same way as in the embodiment shown in FIG. 1.

Figure 3:
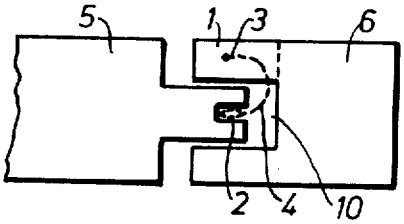

In FIG. 3, the membrane 4 is cemented or bonded 2 on one side into a groove surrounding the graphite plate and, on its other side, is cemented into the cementing lug 1 on the electrolysis frame in the same way as in the embodiment illustrated in FIG. 2. This embodiment is also suitable for non-cementable film, assembly is facilitated and the sliding surfaces are completely free from bonds. The groove guarantees a safe, gas tight connection.

Figure 4:
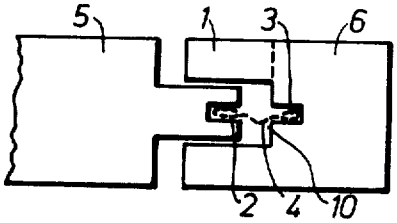

In FIG. 4, the membrane 4 is cemented or bonded into grooves in the frame 3 and graphite plate 2. The frame groove may also be arranged otherwise than shown here, depending upon the frame design.

Figure 5:
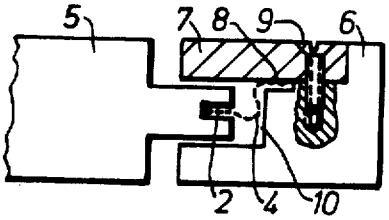

In FIG. 5, the membrane 4 is cemented or bonded on one side into a groove in the graphite plate 2, and, on its other side, is clamped, cemented or bonded 8 below a frame member 7. The frame member is either screwed on 9 and/or bonded on (not shown in the drawing). The screws may be made of a resistant material, for example polypropylene.

Figure 6:
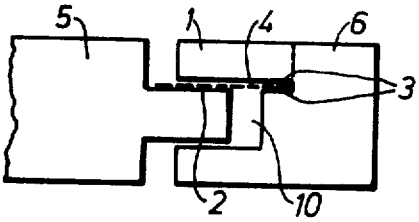

In FIG. 6, the membrane is applied in the form of a flat seal in the same way as in FIG. 4, but is situated in a favorable position from the point of view of production by wider recessing of the frame. The use of a film, for example polytetrafluorethylene etched on one side, which is bonded to the frame and to the graphite plate, for example with furan resin, has the advantage of eliminating the need for the separation film required in the case of a cloth or nonwoven, because the cementing lug does not adhere to the unedged upper surface of the film. Similarly there is no need for the supporting frame member because the film is stiff enough to prevent sinking into the hollow space between the graphite plate and electrolysis frame. If necessary, a supporting filling (for example a Styroper filler) may be introduced into the hollow space for assembly purposes and may subsequently be left there without any adverse effect upon the relative movement between the frame and the graphite plate.

In the vicinity of the frame 6, the film may with advantage be etched on both sides in order to enable the cement to adhere there.

In another advantageous embodiment (not illustrated), a seal, for example of asbestos fibers, may be introduced into the intermediate space 10 in addition to the membrane seal.

It will be appreciated that the instant specification and examples are set forth by way of illustration and not limitation, and that various modifications and changes may be made without departing from the spirit and scope of the present invention.

What is claimed is:

1. In a hydrochloric acid electrolysis plate and frame assembly comprising a graphite plate and a frame about said plate so as to provide a gas tight seal while maintaining a sliding fit, the improvement which comprises a tension-free membrane seal fastened to the frame and to the plate across the the space where sliding movement therebetween can occur.

2. A plate and frame assembly according to claim 1, wherein said membrane comprises a fabric or film of polyvinyl chloride, polypropylene or a poly-fluoroolefin.

3. A plate and frame assembly according to claim 1, wherein said membrane is fastened to at least one of said frame and plate by being cemented or bonded.

4. A plate and frame assembly according to claim 1, including an additional resilient seal in the space between said plate and frame which space changes in size upon sliding between said plate and frame.

5. A plate and frame assembly according to claim 4, wherein said membrane comprises a fabric or film of polyvinyl chloride, polypropylene or a poly-fluoroolefin and is fastened to at least one of said frame and plate by being cemented or bonded.

6. An electrolysis cell block comprising a plurality of joined plate and frame assemblies according to claim 1.

* * * * *